United States Patent [19]

Donomoto et al.

[11] Patent Number: 4,530,875

[45] Date of Patent: Jul. 23, 1985

[54] SILICON CARBIDE WHISKER COMPOSITE MATERIAL WITH LOW NON WHISKER PARTICLE CONTENT AND METHOD OF MANUFACTURE THEREOF

[75] Inventors: Tadashi Donomoto; Yoshiaki Tatematsu; Atsuo Tanaka, all of Toyota, Japan

[73] Assignee: Toyota Jidosha Kabushiki Kaisha, Toyota, Japan

[21] Appl. No.: 536,644

[22] Filed: Sep. 28, 1983

[30] Foreign Application Priority Data

Oct. 13, 1982 [JP] Japan ..... 57-179648

[51] Int. Cl.[3] ..... B22F 1/00; B22F 9/00

[52] U.S. Cl. ..... 428/283; 428/285; 428/289; 428/367; 428/372; 428/389; 428/698

[58] Field of Search ..... 428/698, 367, 372, 389, 428/283, 295, 288, 285

[56] References Cited

U.S. PATENT DOCUMENTS 3,098,723 7/1963 Micks ..... 428/389

3,432,295 3/1969 Frank et al. ..... 428/367 X

FOREIGN PATENT DOCUMENTS 0047012 4/1977 Japan ..... 428/698

*Primary Examiner*—George F. Lesmes

*Assistant Examiner*—Nancy A. B. Swisher

*Attorney, Agent, or Firm*—Oblon, Fisher, Spivak, McClelland & Maier

[57] ABSTRACT

A composite material is made from a whisker body of silicon carbide whiskers containing not more than 5% by weight of non whisker particles of diameter greater than 150 microns, with a mass of matrix metal infiltrated into the interstices of the whisker body. The matrix metal is selected from the group consisting of aluminum, magnesium, tin, copper, lead, zinc, and their alloys. The bulk density of the silicon carbide whiskers is at least 0.07 gm/cm$^3$. A method is also disclosed for making this composite material, in which first a quantity of silicon carbide whiskers containing not more than 5% by weight of non whisker particles of diameter greater than 150 microns is formed into a shaped mass with a compressive strength of at least 0.5 kg/cm$^2$ and with a bulk density of at least 0.07 gm/cm$^3$, and then this shaped mass is compounded with a quantity of the molten matrix metal by a pressure casting method. This formed mass of silicon carbide whiskers may be bound together by an inorganic binder, whicn may be silica, and whose volume percentage in the shaped mass of silicon carbide whiskers may desirably be less than about 25%.

5 Claims, 6 Drawing Figures

SILICON CARBIDE WHISKER COMPOSITE MATERIAL WITH LOW NON WHISKER PARTICLE CONTENT AND METHOD OF MANUFACTURE THEREOF

BACKGROUND OF THE INVENTION

The present invention relates to a composite material and to a method of manufacture thereof, and more particularly relates to a composite material, made up of a mass of silicon carbide reinforcing whiskers embedded within a matrix of metal, which has improved physical characteristics including wear resistance and tensile strength, and to a method of manufacture thereof.

In motor vehicles and aircraft and so forth, nowadays, the constant demand for lightening and strengthening of structural members and parts, with the objects, among others, of providing energy savings by reducing fuel consumption, and also of providing higher traveling speeds, has meant that construction from light alloy such as aluminum alloy or magnesium alloy has become common. Problems arise, however, in making parts from aluminum or magnesium alloys, despite the light weight of these aluminum or magnesium alloys, and despite their easy workability, because the mechanical characteristics of these alloys such as wear resistance, and such as strength including bending resistance, torsion resistance, tensile strength, and so on are inferior to those of competing materials such as steel. Further, the occurrence of cracking and the spreading of cracks in parts made of aluminum or magnesium alloy can be troublesome. Therefore, for parts the strength of which is critical there are limits to the application of aluminum and magnesium alloys.

Accordingly, for such critical members, it has become known and practiced for them to be formed out of so called two phase or composite materials, in which reinforcing material is dispersed within a matrix of metal. If the matrix metal is an aluminum or magnesium alloy, then the advantages with regard to weight and workability of using this aluminum or magnesium alloy as a constructional material can be obtained to a large degree, while avoiding many of the disadvantages with regard to low strength and crackability; in fact, the structural strength of the composite materials made in this way can be very good, and the presence of the reinforcing material can stop the propagation of cracks through the aluminum or magnesium alloy matrix metal.

The reinforcing material conventionally has been known as for exmple being alumina fibers, carbon fibers, silicon carbide whiskers, or possibly mixtures thereof, and the matrix metal has been known as for example being various types of aluminum or magnesium alloy; and various proposals have been made with regard to compositions for such fiber reinforced metal type composite materials, and with regard to methods of manufacture thereof.

Now, however, since such reinforcing fiber materials are vastly harder than the aluminum or magnesium alloy matrix metal in which they are embedded, therefore machining operations and finishing operations for parts formed of such composite materials including such reinforcing fiber materials become much more difficult. Further, during use of the parts, other problems occur: for example, the wear on mating or cooperating members which rub against such parts, sliding relatively to them, may become very great.

Ironically, although the use of silicon carbide whiskers as reinforcing material has appeared to be very promising, since this material is compatible with aluminum alloys which can be thus conveniently used as matrix metal, and since such silicon carbide whiskers have very good rigidity and strength and thus would be very suitable as reinforcing material, these problems associated with wear on a mating or cooperating member are particularly marked in such composite materials including silicon carbide whiskers. Specifically, in a mass of silicon carbide whiskers, because of the method of manufacture thereof, there is generally contained a certain considerable amount of non whisker or fiber shaped silicon carbide particles, which are usually spherical or irregular in shape, of various sizes; the percentage by weight of these non whisker particles, i.e. shot particles, may typically be from between 5% to 50% by weight. The diameters of these non whisker type silicon carbide particles are generally much larger than the diameters of the silicon carbide whiskers, such as several tens to several hundreds of times said whisker diameters, and, since their hardness is second only to that of diamond, being a hardness Hv (50 gms) of at least 1000, it will be readily understood that the working, machining, and finishing of the composite material including such silicon carbide particles become extremely difficult, and that also problems arise with respect to the wear on mating or cooperating members which rub against parts made of such composite material. Further, because it can often occur that such non whisker shaped particles become dislodged from the matrix metal in which they are embedded, scuffing of the material of such mating or cooperating members may well occur, which can cause great damage to such members.

With regard to methods of manufacture of composite materials, various methods of manufacture have been tried, but of these the most generally and usefully applicable has so far been the high pressure casting method, in view of the low cost of the fiber reinforced metal type composite material produced thereby, and the manufacturing efficiency attained thereby. In this high pressure casting method, a mass of reinforcing fibers is placed in the mold cavity of a casting mold, and then a quantity of molten matrix metal is poured into the mold cavity. The free surface of the molten matrix metal is then pressurized to a high pressure such as approximately 1000 kg/cm$^2$ by a plunger or the like, which may be slidingly fitted into the mold. Thereby the molten matrix metal is intimately infiltrated into the interstices of the mass of reinforcing fibers, under the influence of this pressure. This pressurized state is maintained until the matrix metal has completely solidified. Then finally, after the matrix metal has solidfied and cooled into a block, this block is removed from the casting mold, and the surplus matrix metal around the reinforcing fibers may be removed by machining, so that the composite material mass itself, consisting of the mass of reinforcing fibers impregnated with matrix metal, is isolated. This high pressure casting method has the advantage of low cost, and it is possible thereby to manufacture elements of different shapes including quite complicated shapes with high efficiency.

SUMMARY OF THE INVENTION

Now, the inventors of the present application have considered the above mentioned problems with respect to utilizing silicon carbide whiskers as reinforcing material in a composite material, and have conducted various experimental researches into the manufacture of such composite materials, some of which will be detailed later in this specification, as a result of which they have come to certain conclusions which form the essence of the present invention. In particular, the present inventors have found that it is desirable to maintain the bulk density and amount of such non whisker shaped silicon carbide particles within the reinforcing whisker mass within specific limits, i.e. should not be high. Further, the inventors of the present application have also found that it is desirable that the bulk density of the silicon carbide whiskers in the composite material should itself be maintained to be within specific limits, i.e. should not be low; and that it is desirable that the compression strength of the reinforcing mass of silicon carbide whiskers, before the high pressure casting process is performed, should be maintained within specific limits, i.e. should not be low. Further, the inventors of the present application have also found that it is desirable that the amount of inorganic binder used to hold together this reinforcing mass of silicon carbide whiskers, before the high pressure casting process is performed, should be should be maintained within specific limits, i.e. should not be very high.

Accordingly, it is the primary object of the present invention to provide a composite material including silicon carbide whiskers as the reinforcing material, which has good mechanical characteristics.

It is a further object of the present invention to provide such a silicon carbide whisker reinforced composite material, which has good resistance to wear.

It is a further object of the present invention to provide such a silicon carbide whisker reinforced composite material, which does not produce undue wear on a mating or cooperating member which slides against it.

It is a further object of the present invention to provide such a silicon carbide whisker reinforced composite material, which has good machinability.

It is a further object of the present invention to provide such a silicon carbide whisker reinforced composite material, which has good finishability.

It is a further object of the present invention to provide such a silicon carbide whisker reinforced composite material, out of which various parts may be efficiently and conveniently manufacutred.

It is a further object of the present invention to provide such a silicon carbide whisker reinforced composite material, which has good tensile strength.

It is a yet further object of the present invention to provide such a silicon carbide whisker reinforced composite material, in which the above mentioned problem that non whisker shaped silicon carbide particles may become dislodged from the matrix metal in which they are embedded, does not substantially occur.

It is a further object of the present invention to provide such a silicon carbide whisker reinforced composite material, with the use of which scuffing of the material of mating or cooperating members does not occur.

It is a further object of the present invention to provide such a silicon carbide whisker reinforced composite material, with the use of which great damage to such mating or cooperating members does not occur.

It is a yet further object of the present invention to provide a method of manufacture of such a silicon carbide whisker reinforced composite material, which is efficient.

It is a yet further object of the present invention to provide a method of manufacture of such a silicon carbide whisker reinforced composite material, in which the reinforcing mass of silicon carbide whiskers is sufficiently strong to withstand the stresses that arise during the high pressure casting process.

It is a yet further object of the present invention to provide a method of manufacture of such a silicon carbide whisker reinforced composite material, in which distortion of the reinforcing mass of silicon carbide whiskers during the high pressure casting process is effectively avoided.

It is a yet further object of the present invention to provide a method of manufacture of such a silicon carbide whisker reinforced composite material, in which the development of casting faults such as areas of poor contact between the reinforcing mass of silicon carbide whiskers and the matrix metal during the high pressure casting process is effectively avoided.

It is a yet further object of the present invention to provide a method of manufacture of such a silicon carbide whisker reinforced composite material, in which the development of casting faults such as voids in the composite material during the high pressure casting process is effectively avoided.

According to the most general product aspect of the present invention, these and other objects relating to a product are accomplished by a composite material comprising a whisker body of silicon carbide whiskers containing not more than 5% by weight of non whisker particles of diameter greater than 150 microns, and a mass of matrix metal infiltrated into the interstices of said whisker body, said matrix metal being selected from the group consisting of aluminum, magnesium, tin, cooper, lead, zinc, and their alloys, in which the bulk density of the silicon carbide whiskers is at least 0.07 $gm/cm^3$.

According to such a product, since the matrix metal which is aluminum alloy or the like is reinforced by the silicon carbide whisker reinforcing material, which has superior strength and wear resistance characteristics, thereby the composite material has good mechanical characteristics, including good wear resistance and good tensile strength. Thus, this composite material is very suitable for the efficient and convenient manufacture of various parts. Further, since the quantity of the non whisker shaped silicon carbide particles is restricted as specified above, a part manufactured from the silicon carbide whisker reinforced composite material according to the present invention does not produce undue wear on a mating or cooperating member which slides against it. Moreover this silicon carbide whisker reinforced composite material has good machinability and finishability. Further, the occurrence of dislodgement of such non whisker shaped silicon carbide particles from the matrix metal in which they are embedded is not substantially troublesome, because the amount of such particles is so restricted. Accordingly, scuffing of the material of mating or cooperating members does not occur, and great damage to such mating members is avoided.

Further, according to a more particular product aspect of the present invention, these and other objects relating to a product are more particularly and concretely accomplished by such a composite material as detailed above, wherein said whisker body contains not more than 3% by weight of non whisker particles of diameter greater than 150 microns; and more particularly wherein said whisker body contains not more than 1% by weight of non whisker particles of diameter greater than 150 microns.

According to such a product, the advantages obtained as explained above by restricting the quantity of the non whisker shaped silicon carbide particles in the composite material are obtained in still greater degree. It is further considered that it is desirable, in view of the desirability of ensuring proper physical characteristics of the finished composite material, for the overall amount of non whisker shaped silicon carbide particles in the silicon carbide whisker body of the composite material to be kept at less than 10% by weight, and preferably less than 5% by weight.

Further, according to another more particular product aspect of the present invention, these and other objects relating to a product are more particularly and concretely accomplished by such a composite material as described above, wherein the bulk density of the silicon carbide whiskers is at least 0.10 $gm/cm^3$; and more particularly wherein the bulk density of the silicon carbide whiskers is at least 0.15 $gm/cm^3$.

According to such a product, as will be seen later in this specification with regard to the descriptions of the various experimental researches that have been carried out by the inventors, the tensile strength and the wear resistant characteristics of the composite material are advantageously promoted.

According to the most general method aspect of the present invention, these and other objects relating to a method are accomplished by a method for making a composite material, in which: first a quantity of silicon carbide whiskers containing not more than 5% by weight of non whisker particles of diameter greater than 150 microns is formed into a shaped mass with a compressive strength of at least 0.5 $kg/cm^2$ and with a bulk density of at least 0.07 $gm/cm^3$; and then this shaped mass is compounded with a quantity of a molten matrix metal by a pressure casting method; said molten matrix metal being selected from the group consisting of aluminum, magnesium, tin, copper, lead, zinc, and their alloys.

According to such a method, since the resulting product is composed of the matrix metal which is aluminum alloy or the like, reinforced by the silicon carbide whisker reinforcing material which has superior strength and wear resistance characteristics, thereby the resulting composite material has good mechanical characteristics, including good wear resistance and good tensile strength. Since the quantity of the non whisker shaped silicon carbide particles in the raw material for this manufacturing process is restricted as specified above, according to the method of the present invention, a part manufactured from the resulting silicon carbide whisker reinforced composite material does not produce undue wear on a mating or cooperating member which slides against it. Moreover this silicon carbide whisker reinforced composite material has good machinability and finishability, and the occurrence of dislodgement of such non whisker shaped silicon carbide particles from the matrix metal in which they are embedded is not substantially troublesome, because the amount of such particles is so restricted. Accordingly, scuffing of the material of mating or cooperating members does not occur, and great damage to such mating members is avoided. Yet further, because the compressive strength of the shaped mass of silicon carbide whiskers, before the high pressure casting process, is made to be at least 0.5 $kg/cm^2$, thereby it is rendered capable of resisting and withstanding the compressive forces which it receives from the molten matrix metal during this high pressure casting, and accordingly distortion of the reinforcing mass of silicon carbide whiskers during the high pressure casting process is effectively avoided. Further, the development of casting faults such as voids, or such as areas of poor contact between the reinforcing mass of silicon carbide whiskers and the matrix metal, during the high pressure casting process is effectively avoided. If this condition relating to the compression strength of the shaped reinforcing mass of silicon carbide whiskers is not satisfied, then quite possibly it will no longer be possible to implant the reinforcing silicon carbide whiskers in the correct location in the finished product.

Further, according to a more particular method aspect of the present invention, these and other objects relating to a method are more particularly and concretely accomplished by such a method of making a composite material as described above, wherein the compressive strength of said shaped mass of silicon carbide whiskers is at least 0.8 $kg/cm^2$.

According to such a method, the above mentioned advantages acquired by making the compression strength of the shaped mass of silicon carbide whiskers high are realized to an even greater extent.

Further, according to another more particular method aspect of the present invention, these and other objects relating to a method are more particularly and concretely accomplished by further restricting the content of the non whisker shaped silicon carbide particles in the raw material for this manufacturing process, as mentioned above with respect to the product aspect of the present invention; and in this case naturally the same advantages accrue. Further, these and other objects relating to a method are more particularly and concretely accomplished by further keeping the bulk density of the shaped mass of silicon carbide whiskers to be higher than various limit amounts, as also mentioned above with respect to the product aspect of the present invention; and in this case also naturally the same advantages accrue as mentioned above.

Further, according to a yet more particular method aspect of the present invention, these and other objects relating to a method are more particularly and concretely accomplished by such a method of making a composite material as described above, wherein said formed mass of silicon carbide whiskers is bound together by an inorganic binder; and this organic binder may be silica.

According to such a method, this provides a convenient way of holding together the shaped mass of silicon carbide whiskers and ensuring that it has a good compression strength as specified above; and since such an inorganic binder does not lose its holding together power even under the relatively high temperature of the molten matrix metal, the advantages mentioned above relating to keeping the compression strength of the silicon carbide whisker mass high during the casting process are effectively accomplished. Other possibilities for the inorganic binder include aluminum phosphate, cement, waterglass, or colloidal alumina or colloidal silica, which has been solidified by drying. The inorganic binder may be conveniently applied by mixing it in an aqueous solution or the like with the silicon carbide whiskers, stirring the mixture, and then forming the shaped mass of silicon carbide whiskers by vacuum forming, compression forming, extrusion forming, or the like, afterwards drying and/or firing said shaped silicon carbide whisker mass.

However, since when the inorganic binder is included in too great an amount within the whisker mass it is found that the good and intimate contact between the silicon carbide whiskers and the matrix metal is impeded, therefore as a result of experiments it has been found that it is desirable that the volume percentage of said inorganic binder in said shaped mass of silicon carbide whiskers should be less than about 25%; and particularly, when the bulk density of the shaped mass of silicon carbide whiskers is high, it has been found that it is desirable that the volume percentage of said inorganic binder in said shaped mass of silicon carbide whiskers should be less than about 20%.

With regard to the results of wear tests that were performed upon composite materials according to the product aspect of the present invention, in general the alignment of the silicon carbide whiskers in the matrix metal has been substantially random in one plane, denoted conveniently as the x-y plane, but has been as mostly disposed in layers in the perpendicular or z axis direction, so that they have had a so called two dimensional random orientation. In fact, no doubt it would be ideal for the silicon carbide whiskers to be imparted with random orientations with regard to all three spatial dimensions, but no method has yet been evolved for practically producing this result. Now, in the wear tests performed by the present inventors, it has been discovered that the anti wear characteristics in the x-z plane and in the y-z plane are marginally better than the anti wear characteristic in the x-y plane, but that for other mechanical characteristics than wear resistance there is substantially no difference in the orientation of the test direction or plane. Therefore, in the design of a part using the composite material according to the product aspect of the present invention, it is preferable that the silicon carbide whiskers should be aligned so that a plane requiring particularly good wear resistance characteristics is arranged to be a plane perpendicular to the x-y plane, as specified above.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and feautres are denoted by like reference symbols in the various figures thereof, and:

DESCRIPTION OF THE PREFERRED EMOBODIMENTS

The present invention will now be described with reference to a number of preferred embodiments thereof, and with reference to the appended drawings. The various embodiments will be introduced in the context of five sets of experiments relating to making various silicon carbide whisker reinforced metal type composite materials and testing them that have been performed by and under the aegis of the present inventors with a view to ascertaining the effect upon the qualities of these composite materials of varying different parameters of the materials of which they are made and different parameters of the production process.

FIRST SET OF EXPERIMENTS: THE RELATION BETWEEN NON WHISKER TYPE PARTICLE AMOUNT AND WEAR ON A COOPERATING MEMBER

First, in order to evaluate for such silicon carbide whisker reinforced metal type composite materials the effect on the wear amount of a cooperating member of varying the amount of non silicon carbide whisker shaped particles contained in the silicon carbide reinforcing material, a mass of silicon carbide whiskers, of average whisker diameter 0.4 microns and average whisker length 100 microns, made by Tokai Carbon K.K., was dispersed in water, and this dispersion was passed through a stainless steel net of 100 mesh, so as to reduce the amount of non whisker shaped silicon carbide particles therein with a diameter 150 microns or more to effectively zero. Using the thus filter processed silicon carbide whiskers, unprocessed silicon carbide whiskers, and various mixtures of the two, six different machining test samples of composite material, denoted henceforth by the symbols A1 through A6, were made by the high pressure casting method. All of these six test samples utilized the same type of aluminum alloy as the matrix metal: JIS standard AC8A. But each of the six test samples used silicon carbide whisker reinforcing material of a different mix, as follows: the test sample A1 used a mass of silicon carbide whiskers in which the percentage by weight of non whisker shaped particles with diameters greater than 150 microns was 10%, while respectively for the other test samples A2 through A6 this percentage was 7.0%, 5.0%, 3.0%, 1.0%, and 0.2%. Then evaluations were carried out of the wear amounts on machining bits which were used to shape these six machining test samples.

Figure 1:
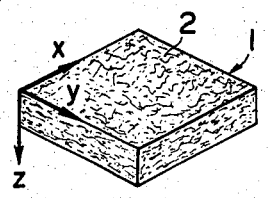
FIG. 1 is a perspective view of a cuboidal body of reinforcing silicon carbide whiskers held together by a dried inorganic binder, as used in the manufacture of various test samples for elucidating the proper constitution of the product of the present invention.

In detail, each of these six test samples was made as follows. Each of the six thus mixed masses of silicon carbide whisker reinforcing material was dispersed in colloidal silica and then stirred up, and then by the per se well known vaccuum forming method a silicon carbide whisker body 1, of approximate dimensions 80 mm by 80 mm by 20 mm, was formed, as shown in perspective view in FIG. 1, held together securely by the dried silica, which functioned as an inorganic binder. The silicon carbide whisker body 1 was then fired at about 600° C., so as to cause the individual whiskers to be held together by the silica; in this way, the compressive strength of the silicon carbide whisker body 1 was made to be about 1.8 kg/cm$^2$. The individual silicon carbide whiskers 2 in this whisker body 1 were oriented randomly in the x-y plane, but mostly were disposed in layers in the z direction, so that they had a so called two dimensional random orientation.

The bulk density of this whisker body 1, in the six cases A1 through A6, was respectively about 0.10 gm/cm$^3$, 0.11 gm/cm$^3$, 0.10 gm/cm$^3$, 0.11 gm/cm$^3$, 0.11 gm/cm$^3$, and 0.12 gm/cm$^3$, i.e. almost the same in each case; and the silica binder was present in the respective percentages of 13.9% by volume (i.e., 11% by weight), 12.6% (10%), 13.9% (11%), 13.2% (10.5%), 13.9% (11%), and 12.6% (10%), i.e. again almost the same in each case. Therefore the effects of variation of these two parameters, in this first set of experiments, can be ruled out.

Figure 3:
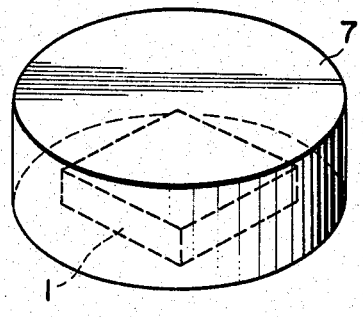
FIG. 3 is a perspective view of a cylindrical body of solidified matrix metal with the body of reinforcing silicon carbide whiskers of FIG. 1 included in the interior thereof, as produced by the apparatus of FIG. 2 according to the method of the present invention.
Figure 2:
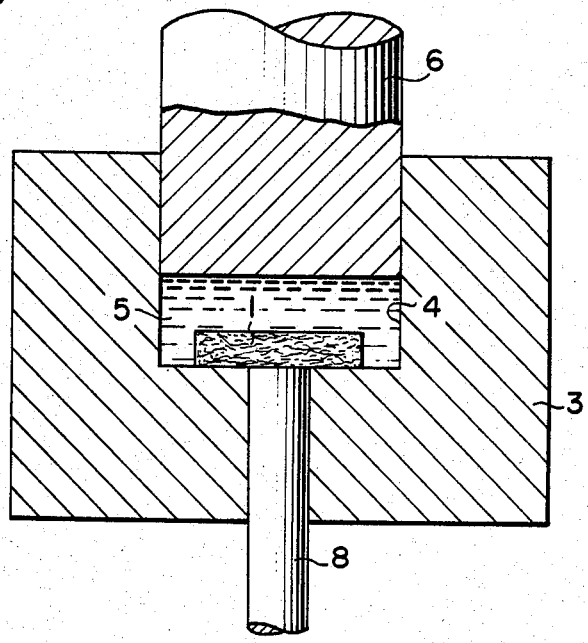
FIG. 2 is a schematic sectional view of a pressurized casting apparatus, used in the method of the present invention for compounding molten matrix metal and reinforcing silicon carbide whisker bodies such as that shown in FIG. 1.

Next, as shown in FIG. 2, each of the silicon carbide whisker bodies 1 was placed within a mold cavity 4 of a casting mold 3, and then into this mold cavity 4 was poured a quantity of molten aluminum alloy 5 at approximately 740° C., which as stated above was composed of aluminum alloy of JIS standard AC8A. The surface of this molten aluminum alloy 5 was then pressurized by a plunger 6 sliding in the mold 3 to a pressure of approximately 1400 kg/cm$^2$, and this pressure was maintained while the molten aluminum alloy 5 cooled, until it was completely solidified. Thereby, a cylindrical block 7 of silicon carbide whisker - aluminum alloy composite material surrounded by aluminum alloy was manufactured, as shown in FIG. 3, about 110 mm in external diameter, and about 50 mm high. By the way, the member 8 is a knock out pin slidingly fitted in the bottom of the mold 3.

Next, in each case, this block 7 was subjected to heat treatment $T_7$, and then from the portion (which was of approximate dimensions 80 mm by 80 mm by 20 mm) of this block 7 which was made of composite material, i.e. from the portion reinforced by silicon carbide whiskers, the respective machining test sample A1 through A6 were made. Each of these test samples was machined with an ultra hard bit at a machining speed of 150 meters per minute, a feed speed of 0.03 mm per revolution, and in a constant flow of coolant water, and in each case the wear amount of the bit was measured.

Figure 4:
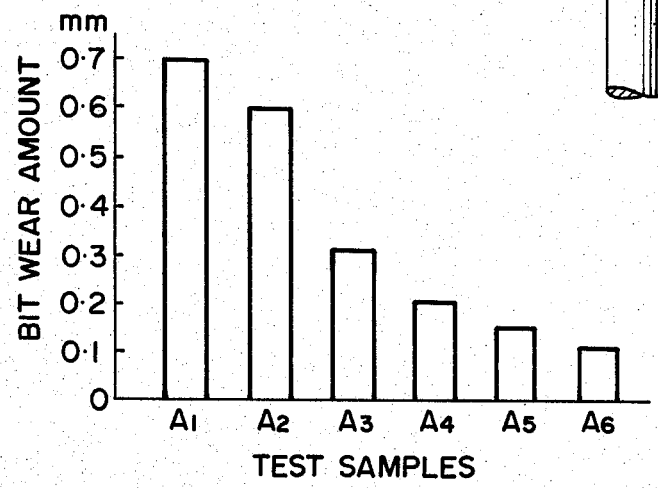
FIG. 4 is a bar chart showing, for each of six machining test samples A1 through A6 of a first set of experiments, wear amount in mm of a machining bit in the vertical direction.

In FIG. 4, which is a bar chart showing wear amount in mm of the respective machining bit for each of the six machining test samples A1 through A6, the results of these wear tests are given. The machining test samples are arranged in order of percentage of non whisker shaped particles with diameters greater than 150 microns. It will be understood from this figure that the greater was the percentage by weight of non whisker shaped particles with diameters greater than 150 microns in the silicon carbide whisker reinforcing material mass 1 of the test sample, the greater was the amount of wear on a cooperating member (i.e., the bit); and in particular in the cases of the test samples A1 and A2, which had the greatest amount of such large particles, the wear amount of the bit was very high. On the other hand, in the cases of the test samples whose silicon carbide whisker reinforcing material masses had very low percentages by weight of non whisker shaped particles with diameters greater than 150 microns, i.e. in the cases of test samples A5 and A6, the wear amount on the cooperating member was quite low. Accordingly, in view of the desirability of providing good wear characteristics for a composite material in which the reinforcing material is a silicon carbide whisker mass, it is seen to be desirable that the percentage by weight of non whisker shaped particles with diameters greater than 150 microns in said silicon carbide whisker reinforcing material mass should be restricted to be 5% or less, and preferably should be restricted to 3% or less, and even more preferably should be restricted to 1% or less.

SECOND SET OF EXPERIMENTS: THE RELATION BETWEEN NON WHISKER TYPE PARTICLE AMOUNT AND TENSILE STRENGTH

Next, in order to evaluate for such silicon carbide whisker reinforced metal type composite materials the effect on the tensile strength thereof of varying the amount of non whisker shaped particles contained in the silicon carbide reinforcing material, in a similar way as in the above described first set of experiments six different pairs of tensile strength test samples of composite material, denoted henceforth by the symbols B1 through B6, were made by the high pressure casting method. In each of these six pairs of tensile strength test samples, one of them used aluminum alloy JIS standard AC4C as the matrix metal, while the other used magnesium alloy JIS standard MC7 as the matrix metal. And each of the six pairs of test samples used silicon carbide whisker reinforcing material of a different mix, in fact corresponding to the machining test samples A1 through A6 of the first set of experiments, as follows: the test sample pair B1 used a mass of silicon carbide whiskers in which the percentage by weight of non whisker shaped particles with diameters greater than 150 microns was 10%, while respectively for the other test sample pairs B2 through B6 this percentage was 7.0%, 5.0%, 3.0%, 1.0%, and 0.2%. Then evaluations were carried out of the tensile strength of each of each of these pairs of these test samples.

In more detail, each of this total of twelve test samples was made as follows. Each one of the total of twelve thus mixed masses of silicon carbide whisker reinforcing material was dispersed in colloidal silica and then stirred up, and then by the per se well known vacuum forming method a silicon carbide whisker body, again of approximate dimensions 80 mm by 80 mm by 20 mm, was formed, as in the case of the first set of experiments, held together securely by the dried silica, which functioned as an inorganic binder. Again, the silicon carbide whisker body was then fired at about 600° C., so as to cause the individual whiskers to be held together by the inorganic silica binder; in this way, the compressive strength of the silicon carbide whisker body was made to be about . . . kg/cm$^2$. The individual silicon carbide whiskers in this whisker body were again oriented randomly in the x-y plane, but mostly were disposed in layers in the z direction, so that they had a so called two dimensional random orientation. The bulk density of this whisker body, in all of the six cases B1 through B6, was 0.62 gm/cm$^3$, i.e. the same in each case; and the silica binder was in each case present in the volume percentage of 18.9%, or the weight percentage of 15%, i.e. again the same in each case. Therefore the effects of variation of these two parameters, in this second set of experiments, again can be ruled out.

Next, similarly to what was done in the first set of experiments detailed above, each of these silicon carbide whisker bodies was placed within a mold cavity of a casting mold, and then into this mold cavity was poured a quantity of molten matrix metal at approximately 760° C., which as stated above was composed either of aluminum alloy of JIS standard AC4C, or of magnesium alloy of JIS standard MC7, one of each for each of the pairs of tensile strength test samples B1 through B6. Again, the surface of this molten matrix metal was then pressurized by a plunger sliding in the mold to a pressure, this time, of approximately 1000 kg/cm$^2$, and this pressure was maintained while the molten matrix metal cooled, until it was completely solidified. Thereby, in each case, a cylindrical block of silicon carbide whisker - matrix metal composite material surrounded by matrix metal was manufactured, as in the case of the first set of experiments, about 110 mm in external diameter and about 50 mm high.

Next, from the portion of this block which was made of composite material, i.e. from the portion reinforced by silicon carbide whiskers, the respective tensile test sample of the respective pair B1 through B6 was made, each being a strip of length 100 mm, width 10 mm, and thickness 2 mm. Further, another tensile strength comparison sample pair B0 was made, consisting of one piece of pure aluminum alloy matrix metal JIS standard AC4C, and one piece of pure magnesium alloy matrix metal JIS standard MC7, both without any silicon carbide reinforcing whiskers. Each of these fourteen test samples was then tested, and in each case the tensile strength was measured.

Figure 5:
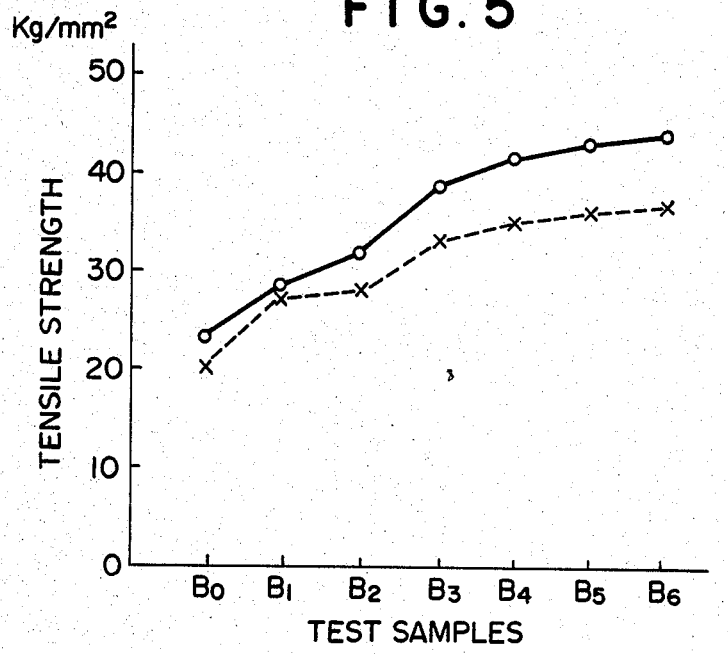
FIG. 5 is a graph showing, for each of fourteen tensile strength test samples B0 through B6 of a second set of experiments, tensile strength in $kg/mm^2$ in the vertical direction.

In FIG. 5, which is a graph showing tensile strength in kg/mm$^2$ of each one of each pair of the tensile strength test samples B0 through B6, the results of these tensile strength tests are given. The tensile strength test samples are arranged in order of percentage of non whisker shaped particles with diameters greater than 150 microns. In this figure, the data points indicated by circles, and the solid line joining them, represent the data for those of the tensile strength test samples which utilized aluminum alloy for the matrix metal, while the data points indicated by crosses, and the dashed line joining them, represent the data for those of the tensile strength test samples which utilized magnesium alloy for the matrix metal. It will be understood from this figure that the greater was the percentage by weight of non whisker shaped particles with diameters greater than 150 microns in the silicon carbide whisker reinforcing material mass of the test sample, the lower was the tensile strength; and in particular, in the cases of the test samples B1 and B2, which had the greatest amount of such large particles, the tensile strength was quite low, almost as low as the tensile strength of the corresponding test sample B0 formed of matrix metal without any reinforcement. On the other hand, in the cases of the test samples whose silicon carbide whisker reinforcing material masses had very low percentages by weight of non whisker shaped particles with diameters greater than 150 microns, i.e. in the cases of test samples B5 and B6, the tensile strength was very satisfactory. Accordingly, in view of the desirability of providing good tesnile strength for a composite material in which the reinforcing material is a silicon carbide whisker mass, it is seen to be desirable that the percentage by weight of non whisker shaped particles with diameters greater than 150 microns in said silicon carbide whisker reinforcing material mass should be restricted to be 5% or less, and preferably should be restricted to 3% or less, and even more preferably should be restricted to 1% or less.

THIRD SET OF EXPERIMENTS: THE RELATION BETWEEN BULK DENSITY AND TEST SAMPLE WEAR

Next, in order to evaluate for such silicon carbide whisker reinforced metal type composite materials the effect on the wear of a test sample thereof of varying the bulk density of the mass of silicon carbide reinforcing material, in a similar way as in the above described first and second sets of experiments six different wear test samples of composite material, denoted henceforth by the symbols C1 through C6, were made by the high pressure casting method. In each of these six wear test samples, aluminum alloy JIS standard AC8A was used as the matrix metal. And all of the six wear test samples used silicon carbide whisker reinforcing material of the same mix, in fact intermediate between the machining test samples A5 and A6 of the first set of experiments, said reinforcing material being in each case a mass of silicon carbide whiskers in which the percentage by weight of non whisker shaped particles with diameters greater than 150 microns was 0.7%, i.e. was very low, in order to reap the advantages of such low non whisker shaped particle percentage as shown by the first and second sets of experiments. However, the bulk density of each of the wear test samples was different, in order to discover the effect of variation of this parameter on the wear amount of the sample. Then evaluations were carried out of the wear of each of these test samples.

In more detail, each of these six test samples was made as follows. Each one of six such masses of silicon carbide whisker reinforcing material was dispersed in colloidal silica and then stirred up, and then by the per se well known vacuum forming method a silicon carbide whisker body, again of approximate dimensions 80 mm by 80 mm by 20 mm, was formed, as in the case of the first and second set of experiments, held together securely by the dried silica, which functioned as an inorganic binder. Again, the silicon carbide whisker body was then fired at about 600° C., so as to cause the individual whiskers to be held together by the inorganic silica binder; in this way, the compressive strength of the silicon carbide whisker body was made to be about . . . kg/cm$^2$. The individual silicon carbide whiskers in this whisker body were again oriented randomly in the x-y plane, but mostly were disposed in layers in the z direction, so that they had a so called two dimensional random orientation. The bulk density of this whisker body, in the six cases C1 through C6, was varied, and was respectively: 0.04 gm/cm$^3$, 0.07 gm/cm$^3$, 0.11 gm/cm$^3$, 0.16 gm/cm$^3$, 0.35 gm/cm$^3$, and 1.2 gm/cm$^3$; and the silica binder was in each case present in the volume percentage of, respectively, 13.9%, 12.3%, 11.6%, 11.3%, 11.0%, and 11.0%, which respectively correspond to weight percentages of 11.0%, 9.8%, 9.2%, 9.0%, 8.7%, and 8.7%. Thus the silica binder was present in nearly the same percentage in each of the six wear test samples, and thus the effects of variation of this parameter, in this third set of experiments, can be ignored.

Next, similarly to what was done in the first and second sets of experiments detailed above, each of these silicon carbide whisker bodies was placed within a mold cavity of a casting mold, and then into this mold cavity was poured a quantity of molten matrix at approximately 740° C., which as stated above was composed of aluminum alloy of JIS standard AC8A. Again, the surface of this molten matrix metal was then pressurized by a plunger sliding in the mold to a pressure of approximately 1000 kg/cm$^2$, and this pressure was maintained while the molten matrix metal cooled, until it was completely solidified. Thereby, in each case, a cylindrical block of silicon carbide whisker - matrix metal composite material surrounded by matrix metal was manufactured, as in the case of the first and second sets of experiments, about 110 mm in external diameter and about 50 mm high.

Next, from the portion of this block which was made of composite material, ie. from the portion reinforced by silicon carbide whiskers, the respective wear test sample C1 through C6 was made, each being a block of dimensions 16 mm by 6 mm by 10 mm, having one surface of dimensions 16 mm by 10 mm as the test surface. Further, another wear comparison sample C0 was made, consisting of a block of pure aluminum alloy matrix metal JIS standard AC8A, without any silicon carbide reinforcing whiskers. Each of these seven test samples was then mounted (in turn) in a LFW frictional testing machine, and was rubbed with a surface pressure of 20 kg/mm$^2$ and at a sliding speed of 0.3 meters/-second against the outer surface of a tubular test sample, which constituted the mating element, and was made of globular graphite cast iron, JIS standard FCD70, which had an external diameter of 35 mm, an internal diameter of 30 mm, and a width of 10 mm, while supplying lubricating oil (Castle motor oil, 5W-30, at a constant temperature of 35° C.) to the contacting rubbing portions thereof, and in each case the wear was meausred after a test period of one hour.

Figure 6:
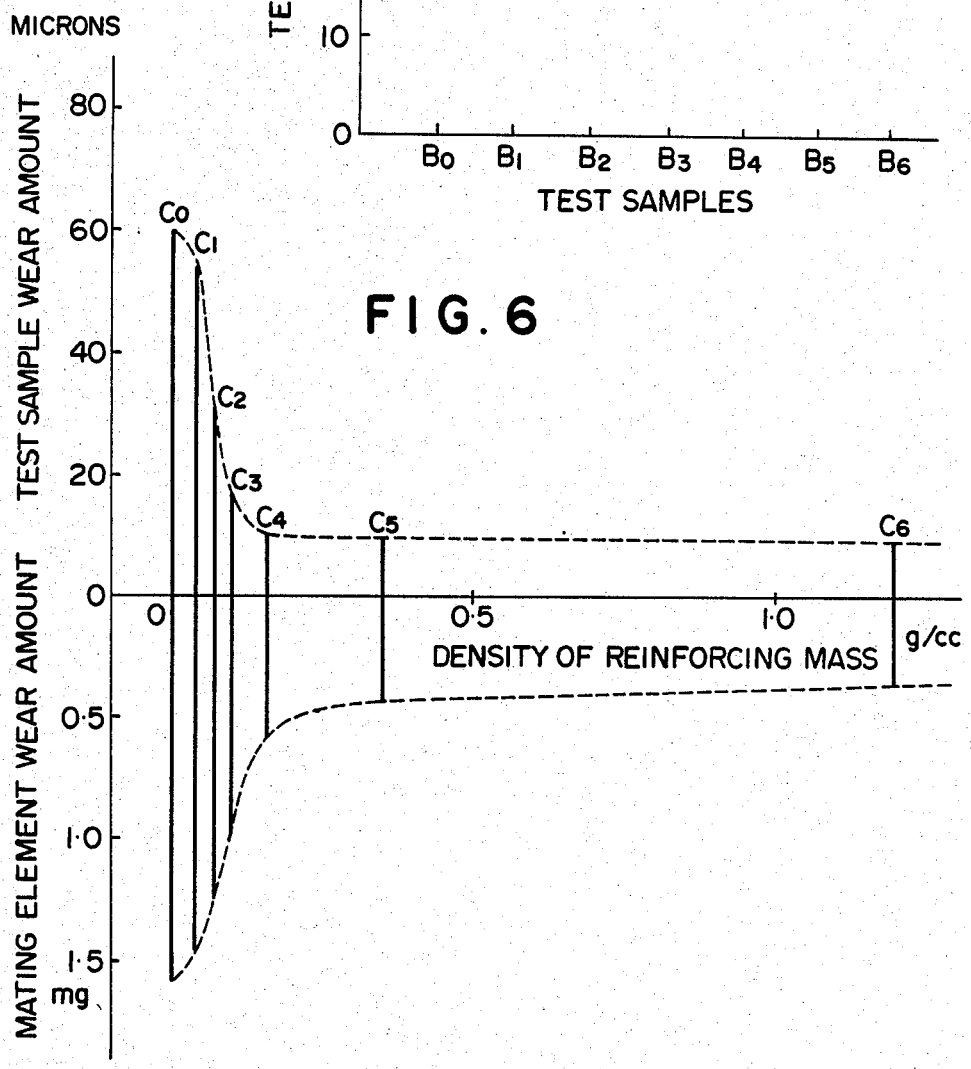
FIG. 6 is a pair of graphs showing wear in microns both of each of a set of wear test samples and of a corresponding surface of a mating element which was rubbed thereagainst, showing above the central horizontal line the depth in microns of the wear of each of the wear test samples, and below it the depth in microns of the wear of the corresponding tubular mating element, in which along the horizontal axis there is given the bulk density in $gm/cm^3$ of the silicon carbide whisker reinforcing material mass.

In FIG. 6, which is a pair of graphs showing wear in microns both of each of the wear test samples C0 through C6 and of the corresponding surface of the mating element which was rubbed thereagainst, the results of these wear tests are given. In this figure, the data points above the central horizontal line represent the depth of the wear in microns of each of the wear test samples, while the data points below said central horizontal line represent the depth of the wear in microns of the corresponding tubular mating element. The horizontal axis shows the bulk density in gm/cm$^3$ of the silicon carbide whisker reinforcing material mass. It will be understood from this figure that the greater was the bulk density of the silicon carbide whisker reinforcing material mass of the test sample, the lower was the wear of both the test sample and the corresponding mating element, up to a bulk density of about 0.2 gm/cm$^3$; and after this point, as the bulk density increased, the wear amount remained essentially constant. Thus, in the cases of the test samples C1 and C2, which had the lowest bulk density for their silicon carbide whisker reinforcing material masses, the wear was rather high, almost as high as the wear in the case of the corresponding test sample C0 formed of matrix metal without any reinforcement. On the other hand, in the cases of the test samples whose silicon carbide whisker reinforcing material masses had high bulk densities of over 0.2 gm/cm$^3$, i.e. in the cases of test samples C4, C5, and C6, the wear, both on the test sample and on the mating member, was low enough to be very satisfactory. Accordingly, in view of the desirability of providing good wear characteristics of the composite material with reinforcing material being a silicon carbide whisker mass, it is seen to be desirable that the bulk density of said silicon carbide whisker reinforcing material mass should be at least 0.07 gm/cm$^3$, and preferably should be at least 0.10 gm/cm$^3$, and even more preferably should be at least 0.15 gm/cm$^3$.

OTHER EXPERIMENTS

Other experiments were made, which will not be particularly detailed herein, using as matrix metal copper alloy, tin alloy, lead alloy, and zinc alloy, and using as reinforcing material silicon carbide whiskers of average diameter 0.2 microns and average length 30 microns, made by Tatehoo Kagaku K.K., and using a tubular mating member of stainless steel JIS standard SUS420J2 with hardness Hv (10 kg) equal to 500. Results were obtained showing substantially the same tendencies as in the third set of experiments detailed above and illustrated in FIG. 6.

FOURTH SET OF EXPERIMENTS: RELATION BETWEEN COMPRESSIVE STRENGTH OF THE WHISKER BODY AND DISTORTION THEREOF

Next, in order to evaluate for such silicon carbide whisker reinforced metal type composite materials the effect on the distortion of the reinforcing whisker body of a test sample thereof of varying the compressive strength of said reinforcing whisker body by varying the amount of inorganic binder used in the manufacture thereof, in a similar way as in the above described first through third sets of experiments five different pairs of distortion test samples of silicon carbide whisker bodies were formed, denoted henceforth by the symbols D1 through D5, and five composite reinforced metal material samples, each incorporating one of each such pair of distortion test samples, were made by the high pressure casting method. In each of these five distortion test samples of composite reinforced metal material, aluminum alloy JIS standard AC8A was used as the matrix metal. And all of the five pairs of whisker body distortion test samples used silicon carbide whisker material of the same mix, in fact the same as the mix of the machining test sample A5 of the first set of experiments, said silicon carbide whisker material being in each case a mass of silicon carbide whiskers in which the percentage by weight of non whisker shaped particles with diameters greater than 150 microns had been reduced by the previously described process of filtration through a stainless steel 100 mesh screen to about 1.0%, i.e. had been reduced to a very low level, in order to reap the advantages of such low non whisker shaped particle percentage as shown by the first through third sets of experiments. However, the amount of inorganic binder used in the manufacture of each of the five distortion test samples was different, so as to make its compressive strength different, in order to discover the effect of variation of this parameter on the distortion amount of the sample after it was formed into a composite material by compounding with matrix metal.

In more detail, each of these five disortion test sample pairs D1 through D5 was made as follows. Each pair of five pairs of such masses of silicon carbide whisker reinforcing material was dispersed in colloidal silica, the concentration of the colloidal silica varying between the various test sample pairs, and then was stirred up, and then by the per se well known vacuum forming method a pair of silicon carbide whisker bodies, each again of approximate dimensions 80 mm by 80 mm by 20 mm, were formed, as in the case of the first through the third sets of experiments, each held together securely by the dried silica, which functioned as an inorganic binder. Again, the silicon carbide whisker bodies were then fired at about 600° C., so as to cause the individual whiskers of each of them to be held together by the inorganic silica binder. The individual silicon carbide whiskers in the whisker bodies were again oriented randomly in the x-y plane, but mostly were disposed in layers in the z direction, so that they had a so called two dimensional random orientation. The bulk density of each of these whisker bodies, in the five cases D1 through D5, was substantially the same, being approximately 0.15 gm/cm$^3$, and thus the effects of variation of this parameter, in this fourth set of experiments, can be ignored; while the volume percentage of the silica binder was varied to a large extent, being in the respective five cases: 3.8%, 6.3%, 8.8%, 15.1%, and 31.5%, which respectively correspond to weight percentages of 3%, 5%, 7%, 12%, and 25%.

As a next step, the compression strength of one of each of the five paris D1 through D5 of the silicon carbide reinforcing whisker masses thus formed was measured. This was of course a destructive test; this is the reason for forming two of each type of whisker mass D1 through D5. This test was made in a direction lying in the x-y plane as seen from the point of view of FIG. 1, i.e. in a direction substantially perpendicular to the direction in which the reinforcing whiskers were layered. The measurement was made by applying a compression load by means of a platen, gradually increasing this compression load, and observing at what load breaking or buckling of the whisker mass occurred, or a 10% or greater deformation occurred. For the respective distortion test samples D1 through D5, the compressive strength of the silicon carbide whisker body was thus measured to be about 0.2 kg/cm$^2$, 0.5 kg/cm$^2$, 0.8 kg/cm$^2$, 2.3 kg/cm$^2$, and 5.8 kg/cm$^2$.

Next, similarly to what was done in the first through the third sets of experiments detailed above, the remaining one of each of these pairs D1 through D5 of silicon carbide whisker bodies was placed within a mold cavity of a casting mold, and then into this mold cavity was poured a quantity of molten matrix metal at approximately 760° C., which as stated above was composed of aluminum alloy of JIS standard AC8A. Again, the surface of this molten matrix metal was then pressurized by a plunger sliding in the mold to a pressure of approximately 1600 kg/cm$^2$, and this pressure was maintained while the molten matrix metal cooled, until it was completely solidified. Thereby, in each case, a cylindrical block of silicon carbide whisker - matrix metal composite material surrounded by matrix metal was manufactured, as in the case of the first and second sets of experiments, about 110 mm in external diameter and about 50 mm high.

Next, in each case, this block was broken for observation, and then the amount of distortion of the included reinforcing silicon carbide whisker mass in the portion of this block which was made of composite material was determined by observation. The results were, for the distortion test samples D1 through D5, respectively: 50% distortion, 10% distortion, substantially no distortion, substantially no distortion, and substantially no distortion. Thus, in the cases of the test samples D1 and D2, which had the lowest compressive strength for their silicon carbide whisker reinforcing material masses, the distortion amount after formation into composite material with matrix metal was rather high. On the other hand, in the cases of the other three test samples D3, D4, and D5, whose silicon carbide whisker reinforcing material masses had higher compressive strengths, the distortion of the reinforcing material masses after high pressure casting was low enough to be very satisfactory. Accordingly, in view of the desirability of providing low reinforcing material distortion of such a composite material with reinforcing material a silicon carbide whisker mass, it is seen to be desirable that the compressive strength of said silicon carbide whisker reinforcing material mass should be at least 0.5 kg/cm$^2$, and preferably should be at least 0.8 kg/cm$^2$.

FIFTH SET OF EXPERIMENTS: RELATION BETWEEN AMOUNT OF BINDER IN THE WHISKER BODY AND CASTING DEFECTS THEREIN

Next, in order to evaluate for such silicon carbide whisker reinforced metal type composite materials the effect on the occurrence of casting defects in a test sample thereof of varying the amount of inorganic binder used in the manufacture of the reinforcing silicon carbide whisker mass thereof, in a similar way as in the above described fourth set of experiments eight different casting test samples, denoted henceforth by the symbols E1 through E8, of silicon carbide whisker reinforced composite material, were formed by the high pressure casting method. In each of these eight casting test samples of composite reinforced metal material, aluminum alloy JIS standard AC8A was used as the matrix metal. And all of the eight casting test samples used silicon carbide whisker material of the same mix, in fact the same as the mix of the machining test sample A5 of the first set of experiments, said silicon carbide whisker material being in each case a mass of silicon carbide whiskers in which the percentage by weight of non whisker shaped particles with diameters greater than 150 microns had been reduced by the previously described process of filtration through a stainless steel 100 mesh screen to about 1.0%, i.e. had been reduced to a very low level, in order to reap the advantages of such low non whisker shaped particle percentage as shown by the first through fourth sets of experiments. However, the amount of inorganic binder used in the manufacture of each of the eight casting test samples was different, in order to discover the effect of variation of this parameter on the casting amount of the sample after it was formed into a composite material by compounding with matrix metal; and also two different values for the bulk density of the silicon carbide whisker reinforcing mass were used.

In more detail, each of these eight casting test samples E1 through E8 was made as follows. Each of eight such masses of silicon carbide whisker reinforcing material was dispersed in colloidal silica, the concentration of the colloidal silica varying between the various test sample pairs, and then was stirred up, and then by the per se well known vacuum forming method a silicon carbide whisker body, again of approximate dimensions 80 mm by 80 mm by 20 mm, was formed, as in the case of the first through the fourth sets of experiments, held together securely by the dried silica which functioned as an inorganic binder. Again, these silicon carbide whisker bodies were then fired at about 600° C., so as to cause the individual whiskers of each of them to be held together by the inorganic silica binder. The individual silicon carbide whiskers in the whisker bodies were again oriented randomly in the x-y plane, but mostly were disposed in layers in the z direction, so that they had a so called two dimensional random orientation. The volume percentage of the silica binder was varied to a large extent, being in the respective eight cases E1 through E8: 10%, 18%, 25%, 30%, 11%, 19%, 23%, and 29%, which respectively correspond to weight percentages of 7.9%, 14.3%, 19.9%, 23.8%, 8.7%, 15.1%, 18.3%, and 23.0%. Further, the bulk density of these silicon carbide reinforcing whisker bodies, in the four cases E1 through E4, was substantially the same, being approximately 0.11 gm/cm$^3$, while on the other hand it was, in the other four cases E5 through E8, approximately 0.93 gm/cm$^3$; and thus the effects of variation of this parameter, in this fifth set of experiments, were also simultaneously tried.

Next, similarly to what was done in the first through the fourth sets of experiments detailed above, each of the eight casting test sample silicon carbide whisker bodies E1 through E8 was placed within a mold cavity of a casting mold, and then into this mold cavity was poured a quantity of molten matrix metal at approximately 760° C., which as stated above was composed of aluminum alloy of JIS standard AC8A. Again, the surface of this molten matrix metal was then pressurized by a plunger sliding in the mold to a pressure of approximately 1000 kg/cm$^2$, and this pressure was maintained while the molten matrix metal cooled, until it was completely solidified. Thereby, in each case, a cylindrical block of silicon carbide whisker - matrix metal composite material surrounded by matrix metal was manufactured.

Next, in each case, this block was sectioned for observation, and then the number and nature of casting defects, such as absences of proper contact between the reinforcing silicon carbide whiskers and the aluminum alloy matrix metal, or void spaces between the whiskers and the matrix metal, was observed under an electron microscope. The results were, for the four casting test samples E1 through E4, which had a low bulk density of the reinforcing silicon carbide whisker mass equal to approximately 0.11 gm/cm$^3$, respectively: no casting defects, no casting defects, no casting defects, and definite casting defects. On the other hand, for the four casting test samples E5 through E8, which had a high bulk density of the reinforcing silicon carbide whisker mass equal to approximately 0.93 gm/cm$^3$, the results were respectively: no casting defects, no casting defects, a slight number of casting defects, and definite casting defects. Thus, in the cases of the first four test samples E1 through E4, which had low bulk density of their silicon carbide whisker reinforcing material masses, the occurrence of casting defects only was noticeable when the volume percentage of the inorganic binder rose to be above 25%. On the other hand, in the cases of the other four test samples E5 through E8, which had high bulk density of their silicon carbide whisker reinforcing material masses, the occurrence of casting defects started to become noticeable when the volume percentage of the inorganic binder rose to be above 20%. Accordingly, in view of the desirability of providing low occurrence of casting defects in such a composite material with reinforcing material a silicon carbide whisker mass, it is seen to be desirable that the volume percentage of inorganic silica binder should be no more than 25%, and in the case of a high bulk density reinforcing silicon carbide whisker mass preferably should be no more than 20%.

OTHER EXPERIMENTS

Other experimetns were made, which will not be particularly detailed herein, using as inorganic binder colloida alumina. Results were obtained showing substantially the same tendencies as in the sixth set of experiments detailed above, indicating that irrespective of the type of inorganic binder it is preferable that it should not be used in a greater concentration than 25% by volume, in order to prevent the occurrence of casting defects in the finished composite material.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A composite material comprising a shaped mass of silicon carbide whiskers containing not more than 5% by weight of non whisker particles of diameter greater than 150 microns, and a matrix metal infiltrated into the interstices of said whisker body, said matrix metal being selected from the group consisting of aluminum, magnesium, tin, copper, lead, zinc, and their alloys, in which the bulk density, prior to pressure casting, of the silicon carbide shaped mass is at least 0.07 gm/cm$^3$ and the compressive strength is at least 0.5 kg/cm$^2$.

2. A composite material according to claim 1, wherein said whisker body contains not more than 3% by weight of non whisker particles of diameter greater than 150 microns.

3. A composite material according to claim 1, wherein said whisker body contains not more than 1% by weight of non whisker particles of diameter greater than 150 microns.

4. A composite material according to claim 1, wherein the bulk density of the silicon carbide whiskers is at least 0.10 gm/cm$^3$.

5. A composite material according to claim 1, wherein the bulk density of the silicon carbide whiskers is at least 0.15 gm/cm$^3$.

* * * * *